United States Patent [19]

Tölle et al.

[11] Patent Number: 4,560,586

[45] Date of Patent: Dec. 24, 1985

[54] PROCESS OF DEBURRING MOLDINGS MADE FROM GRANULAR MATERIAL

[75] Inventors: Hans Tölle, Wuppertal; Karl Frech; Hartmut Lüdke, both of Lippstadt, all of Fed. Rep. of Germany

[73] Assignees: Carl Kurt Walther GmbH & Co. KG, Wuppertal; Theodor Heimeier Metallwerk GmbH, Erwitte, both of Fed. Rep. of Germany

[21] Appl. No.: 457,987

[22] Filed: Jan. 14, 1983

[30] Foreign Application Priority Data

Jan. 18, 1982 [DE] Fed. Rep. of Germany ..... 3201284

[51] Int. Cl.[4] ..... B29C 1/04

[52] U.S. Cl. ..... 427/134; 51/298; 51/309; 51/313; 51/317; 51/DIG. 28; 106/38.25; 427/133; 427/242; 427/289; 427/346; 427/355

[58] Field of Search ..... 427/133, 134, 242, 289, 427/240, 346, 355, 180; 106/38.25; 51/DIG. 28, 298, 309, 313, 317

[56] References Cited

U.S. PATENT DOCUMENTS

| | | | |
|---|---|---|---|
| 1,991,013 | 2/1935 | Cline | 427/133 |
| 2,174,755 | 10/1939 | Novotny | 51/298 |
| 2,294,239 | 8/1942 | Novotny et al. | 51/298 |
| 2,308,854 | 1/1943 | Barnes | 51/298 |
| 2,817,603 | 12/1957 | Louis | 427/242 |
| 2,968,577 | 1/1961 | Helling | 51/298 |
| 3,313,067 | 4/1967 | Smith et al. | 51/298 |
| 3,424,607 | 1/1969 | Coscia | 106/38.25 |
| 3,450,551 | 6/1969 | Warc et al. | 427/133 |
| 3,684,466 | 8/1972 | Petrone | 51/313 |
| 3,878,142 | 4/1975 | Tisza | 106/38.25 |
| 4,086,067 | 4/1978 | Busch et al. | 51/298 |

*Primary Examiner*—Norman Morgenstern
*Assistant Examiner*—Janyce A. Bell
*Attorney, Agent, or Firm*—Martin A. Farber

[57] ABSTRACT

A process for the deburring of bonded moldings of granular material, for example, casting sand cores, coating them in the same operation with a surface layer. The moldings are circulated within an annular vibrator together with an abrasive body medium which contains a powdered coating agent, the medium being preferably deflocculated by an approximately 50% proportion of hard-foam bodies.

23 Claims, 13 Drawing Figures

FIG.3a
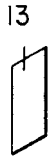
FIG.3c
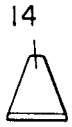
FIG.3e
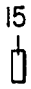
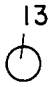
FIG.3b
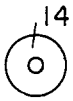
FIG.3d
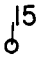
FIG.3f
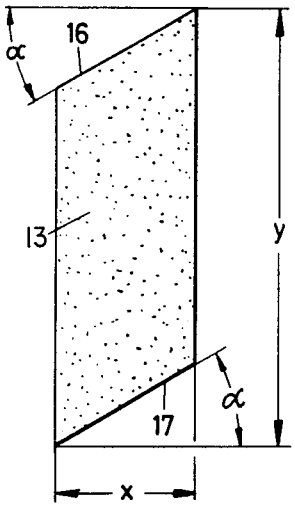
FIG.4
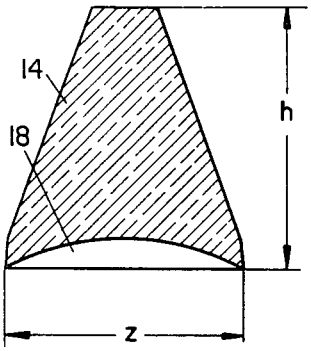
FIG.5
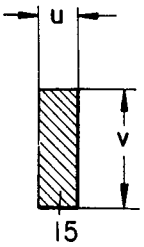
FIG.6

PROCESS OF DEBURRING MOLDINGS MADE FROM GRANULAR MATERIAL

FIELD AND BACKGROUND OF THE INVENTION

The present invention relates to a process of deburring moldings made of granular material, particularly sand cores.

A method is known to manually deburr sand cores consisting of core sand and core binder, particularly for foundry purposes. The sand cores are then coated with a dressing by immersing them into a suitable suspension. After the drying the immersed sand cores the coating of dressing remains on the surface, closing the large pores.

SUMMARY OF THE INVENTION

One object of the invention is to provide a rapid mechanical deburring of such moldings.

This object is achieved by a process for deburring fragile moldings made of granular material comprising the steps of adding hard-foam bodies to abrasive bodies to form a mixture defining an abrasive body medium having a proportion of the hard-foam bodies in the abrasive body medium of more than 50%, and deburring the moldings by abrasive action by vibration and circulation of the moldings with the abrasive body medium along a helical path within an abrasive finishing vibrator machine by vibration.

The object of the present invention is to provide another method by which such moldings can be rapidly deburred mechanically and at the same time be provided with such a dressing without requiring any drying time.

This object is achieved by a process for deburring moldings made of granular material, particularly sand cores, by deburring the sand cores by circulation on a helical path within an abrasive finishing vibrator by adding to the abrasive body medium a powdered coating material to which binder has been added, the coating material, e.g. particularly being a dressing agent.

As a result of this development, there is obtained an automatically operating method of deburring and coating the moldings, particular shot sand cores, with the dressing material. After the production of the cores they are fed to a vibrator, particularly an annular vibrator, which contains the dressing powder and the abrasive body medium. There the content of the container is circulated on a helical path. The hard-foam bodies, which are added in a proportion of about 50%, provide a cushion between the individual sensitive sand cores so as to eliminate the danger of damage. The use of an annular vibrator has the advantage that no separation of the abrasive body medium takes place during the working of the sand cores and, accordingly, gentle handling is assured. The passage time is about 3 to 5 minutes, preferably in a single pass. Accordingly, the cores are fed at one point of the annular vibrator and removed at another, preferably utilizing a removal screen which makes it possible to return the abrasive body medium back into the vibrator. During the travel of the sand cores in the annular vibrator a deburring of the sand cores is accomplished by the abrasive body medium. At the same time, due to the grinding body medium which contains the dressing agent the cores are covered at all places with a uniform coat of dressing which leads to the desired surface effect of the sand cores. In particular, due to the 50% proportion of foamed hard foam bodies the abrasive body medium is of low density. The treatment is preferably effected with large amplitude of vibration. The hard-foam bodies are of such a nature that a slight impression may be made by a fingernail.

The medium is held at the dust limit by a continuously adding a liquid, for instance water. For the carrying out the process the mixture preferably contains a abrasive body medium which comprises about 30% conical abrasive bodies and about 15% aluminum pins, which are deflocculated by about 55% polypropylene hard foam bodies.

The sand cores are provided with an optimum coating with dressing powder if the proportion of dressing agent constitutes about 10% of the volume of the abrasive body medium, particularly good packing of the sand cores in the annular vibrator and optimum deburring are obtained if the hard foam bodies are formed as small cylindrical rods and are sized similarly to the abrasive bodies and if the size of the aluminum pins is only a fraction thereof. Expressed in numbers this means, in one example, that the small cylindrical rods have a diameter of about 8 mm with a total length of about 16–20 mm. The end surfaces of the cylindrical rods preferably extend at an oblique angle to their longitudinal axes. The conical abrasive bodies have a base diameter of about 12 mm. The aluminum pins, on the other hand, have a diameter of 2 mm, and are about 6 mm long. The dressing agent can be a per se conventional powder dressing agent, such as, e.g., graphite, talcum or aluminum silicate. The binder can be a fat-containing material, e.g. oil or wax. The apparatus for carrying out the method of the invention preferably comprises a water spray device with nozzles directed towards the inside of the annular trough and which goes into operation upon the formation of dust, and which is associated with a annular vibrator at the rim of the annular trough therein. The nozzles are uniformly distributed so that the abrasive body medium is given the same degree of moisture, which is close to the dust limit, over the entire length of the annular trough. Finally, the use of polypropylene as a rigid-foam body in an approximately 50% addition to the vibrator abrasive body medium has been found to be advantageous.

BRIEF DESCRIPTION OF THE DRAWINGS

With the above and other objects and advantages in view, the present invention will become more clearly understood in connection with the detailed description of a preferred embodiment, when considered with the accompanying drawings, of which:

FIGS. 3*a* and 3*b*, 3*c* and 3*d* and 3*e* and 3*f* show, in natural size, each in elevation and top view, a polypropylene hard-foam body, a conical abrasive body and an aluminum pin, respectively;

FIG. 4 is a longitudinal section, greatly enlarged, through one polypropylene hard-foam body;

FIG. 5 is a longitudinal section through a conical abrasive body, also greatly enlarged;

FIG. 6 is a longitudinal section through an aluminum pin, greatly enlarged;

DETAILED DESCRIPTION OF THE PREFERRED EMBODIMENTS

Figure 1:
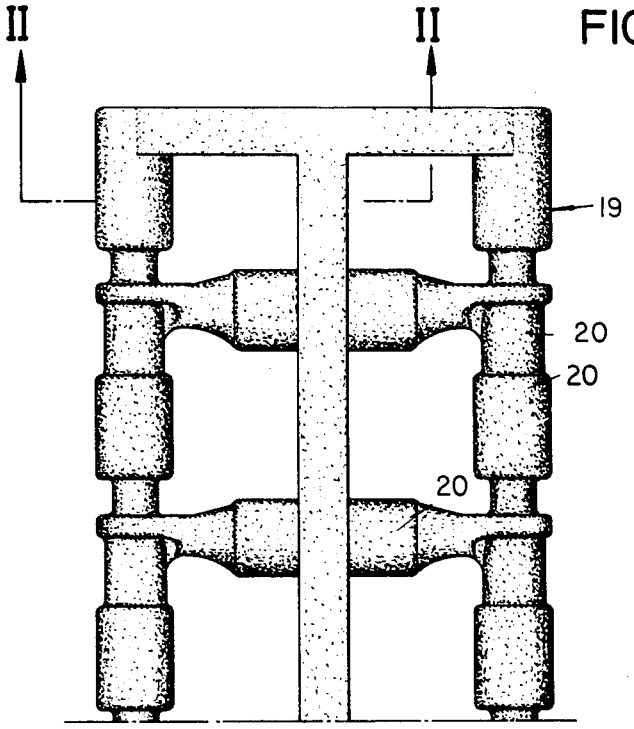
FIG. 1 is a view in elevation of a sand core of normal size which has already been deburred and provided with a dressing.
Figure 2:
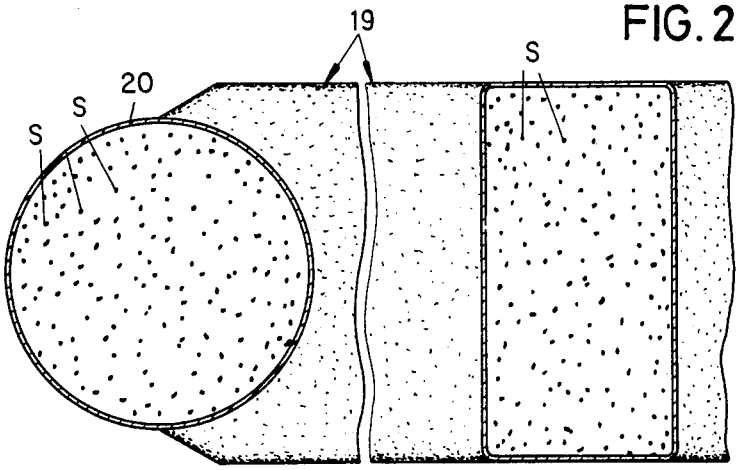
FIG. 2 is a cross section along the line II—II of FIG. 1, on a much larger scale.
Figure 8:
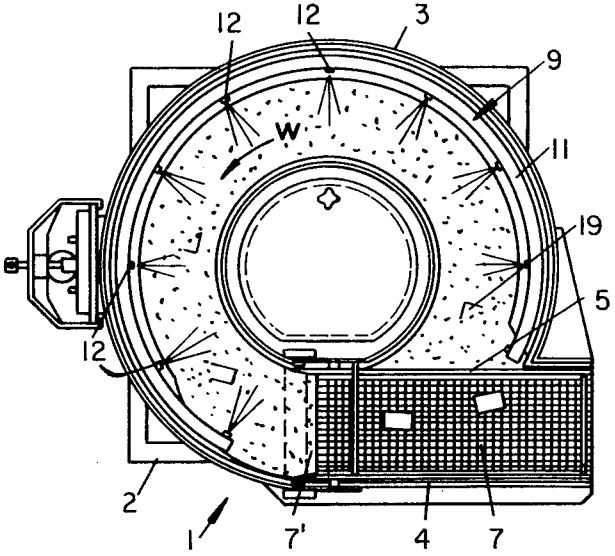
FIG. 8 is a plan view of the apparatus of FIG. 7 carrying out the process.
Figure 7:
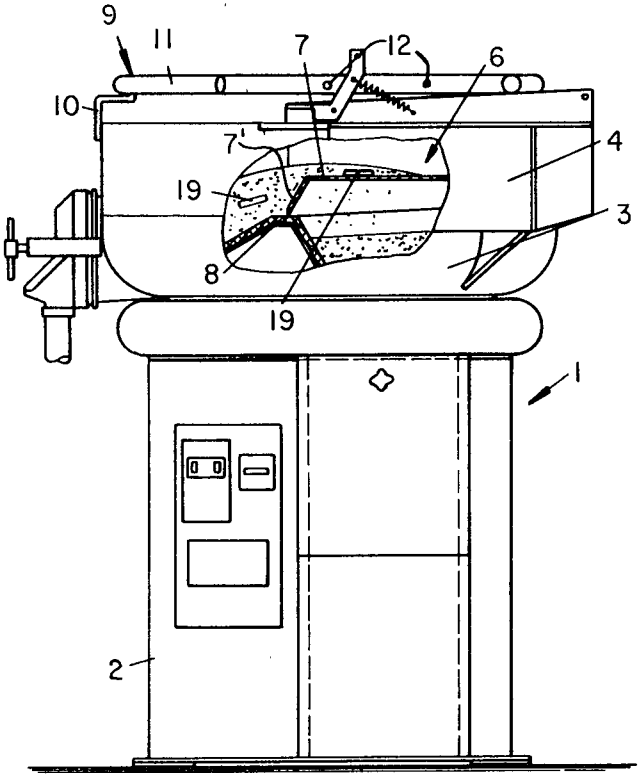
FIG. 7 is an elevational view of an apparatus for carrying out the process, partially broken away.

Referring to FIGS. 7–8 the apparatus for performing the process of the invention is an annular vibrator 1. It is formed with an annular trough 3 which lies in a horizontal plane and is supported in a springing manner with respect to a base stand 2. Vibrations are transmitted to the annular trough 3 by a drive (not shown) and cause the abrasive body medium present therein to traverse a helical path. A discharge chute 6 which is formed of side walls 4 of the container 5 extends in secant-like alignment to the annular trough 3. A discharge and separating device is arranged within the chute. The discharge and separating device has a removable combined screening and separating box, the separating screen 7 of which rests, in the discharge position shown in FIG. 7, via an angularly bent run-on surface 7' acing upstream into the direction of conveyance W, on a weir 8 which extends from the bottom of the trough. The annular trough 3 is provided at its rim with a water spray device 9. The latter has, in particular, a pipe 11 which is adjusted to the course of the annular trough and supported by bracket arms 10, and is provided with nozzles 12 directed towards the inside of the annular trough. The pipe 11 is connected to a water line (not shown).

The abrasive body medium is composed of about 55% polypropylene hard-foam bodies 13, about 30% conical abrasive bodies 14 and about 15% aluminum pins 15.

The polypropylene hard-foam bodies 13 are of cylindrical shape with a diameter x of about 8 mm. Their length y is about 16–20 mm. Their end surfaces 16 and 17 extend obliquely to the longitudinal axis of these cylindrical rods at an angle alpha of about 30° in such a manner that the end surfaces 16, 17 are parallel to each other.

These hard-foam bodies 13 which are formed as cylindrical rods have a size comparable to the conical abrasive bodies 14. The base diameter z of the latter is about 12 mm. The tip of the cone is slightly flattened so that the total height h of the conical abrasive body is about 13 mm. On their base the grinding bodies may form a concavity 18.

The aluminum pins 15 are also of cylindrial shape. Their diameter u is 2 mm and their length v is about 6 mm.

After the annular trough 3 has been filled with the abrasive-body medium, the dressing agent is added, the agent constituting about 10% of the volume of the abrasive body medium. The dressing agent preferably comprises ground feldspar or else mica, i.e. a potash alumina silicate, in which about 10% pulverized stearate is admixed.

If now the annular trough 3 has been filled and placed in vibration, the contents of the container travels on a helical path in the direction w is the annular trough. By means of an apparatus not shown in the drawing, the water spray device 9 receives an impulse to feed water via the nozzles 12 to the inside of the container until the proper degree of moisture, at the dust limit, has been reached.

The sand cores 19, which have been shot by suitable machines and are made of core sand S and core binder, can now be fed to the abrasive body medium in the region of the annular trough adjacent to the separating screen so that the sand cores 19 travel together with the abrasive body medium on the helical path. In this way burrs (not shown) which are still present on the sand cores 19 are removed. The removal does not result in any damage. The sand cores 19 do not damage each other due to the cushion formed by the polypropylene hard-foam bodies 13. During this circulatory movement, the sand cores 19 are simultaneously covered with a coating 20 comprising the dressing agent which closes the pores of the sand core 19 and gives it a smooth surface.

After circulation within the annular trough 3 the contents of the container passes over the weir 8 onto the separating screen 7. The sand cores 19 are removed while the abrasive body medium plus the dressing agent (insofar as it arrives at the screen) drops through the separating screen 7 and is thus fed again to the inside of the annular trough for the next circulation.

It is not necessary to use sand cores for foundry purposes. Other bonded moldings made of, for example, procelain can also be deburred and simultaneously coated with a lacquer, added in the form of a powder.

We claim:

1. A process for deburring fragile moldings made of granular material comprising the steps of adding hard-foam bodies to abrasive bodies to form a mixture defining an abrasive body medium having a proportion of the hard-foam bodies in the abrasive body medium of more than 50%, deburring the moldings by abrasive action by vibration and circulation of the moldings with the abrasive body medium along a helical path within an abrasive finishing vibrator machine by vibrating the machine, said hard-foam bodies have a density substantially lower than that of the abrasive bodies, and have such a degree of hardness that an impression can be made on the hard-foam bodies by a person's fingernail, and wherein during the deburring step, the hard-foam bodies cushion the moldings.

2. The process according to claim 1, wherein said hard-foam bodies are small cylindrical rods.

3. The process according to claim 1, further comprising the step of adding coating material into the abrasive body medium, the moldings being completely coated with the coating material during the deburring step by the circulation and vibration.

4. The process according to claim 3, wherein said coating material is powdered to which a binder has been added.

5. The process according to claim 3, the abrasive body medium includes aluminum pins.

6. The process according to claim 5, wherein the portion of aluminum pins in said abrasive body medium is about 15%.

7. The process according to claim 13, wherein the dressing agent is selected from the group consisting of one of ground feldspar and mica.

8. The process according to claim 1, further comprising the step of adding moisture by continuous dosed addition to the abrasive body medium.

9. The process according to claim 1, wherein said moldings are selected from the group consisting of sand cores and bonded moldings.

10. The process according to claim 9, wherein said bonded moldings are made of porcelain.

11. The process according to claim 2, wherein the cylindrical rods have end surfaces extending obliquely to their longitudinal axes.

12. A process for deburring fragile moldings made of granular material comprising the steps of adding hard-foam bodies to abrasive bodies to form a mixture defining an abrasive body medium having a proportion of the hard-foam bodies in the abrasive body medium of more than 50%, deburring the moldings by abrasive action by vibration and circulation of the moldings with the abrasive body medium along a helical path within an abrasive finishing vibrator machine by vibrating the machine, adding coating material into the abrasive body medium, the moldings being completely coated with the coating material during the deburring steps by the circulation and vibration, the abrasive body medium includes the abrasive bodies, aluminum pins, and the hard-foam bodies, the latter being made of polyproplylene, said hard-foam bodies are small cylindrical rods and have a size which is comparable to that of the abrasive bodies, and the size of the aluminum pins is only a fraction of the size of said hard-foam bodies.

13. The process according to claim 12, wherein said abrasive bodies, said hard-foam bodies and said aluminum pins are in the respective proportions of 30%, 55% and 15%, and said coating material is a dressing agent constituting about 10% of the volume of the abrasive grinding medium.

14. The process according to claim 1, wherein the abrasive bodies are conical.

15. The process according to claim 13, wherein the dressing agent is powdered, and a binder is added.

16. The process according to claim 13, wherein the dressing agent is powdered, and a binder is added comprising a fat-containing material.

17. The process according to claim 16, wherein said powdered dressing agent is selected from the group consisting of one of graphite and talcum.

18. The process according to claim 16, wherein said moldings are castings and said powdered dressing agent is aluminum silicate admixed with about 10% pulverized stearate.

19. The process according to claim 16, wherein the binder of fat-containing material is added as a liquid to the dressing agent.

20. The process according to claim 19, wherein said liquid is oil.

21. The process according to claim 16, wherein the fat-containing material is added in the form of a pasty substance to the dressing agent.

22. The process according to claim 21, wherein said pasty substance is wax.

23. A composition abrasive body medium in an abrasive finishing vibrator machine, comprising polypropylene hard-foam bodies in an amount about 50% added to a vibrator abrasive body medium.

* * * * *